US009168400B2

(12) United States Patent
Schubert et al.

(10) Patent No.: US 9,168,400 B2
(45) Date of Patent: Oct. 27, 2015

(54) EMERGENCY ROPE BAIL-OUT BAG

(75) Inventors: Michael Schubert, Clayton, OH (US); Douglas Sloan, New York, NY (US); Robert West, N. Massapequa, NY (US); Alan W. Schierenbeck, Dayton, OH (US)

(73) Assignee: Honeywell International Inc., Morristown, NJ (US)

( * ) Notice: Subject to any disclaimer, the term of this patent is extended or adjusted under 35 U.S.C. 154(b) by 399 days.

(21) Appl. No.: 13/112,219

(22) Filed: May 20, 2011

(65) Prior Publication Data

US 2011/0284324 A1 Nov. 24, 2011

Related U.S. Application Data

(60) Provisional application No. 61/346,879, filed on May 20, 2010.

(51) Int. Cl.
*A62B 3/00* (2006.01)
*A62B 1/06* (2006.01)

(52) U.S. Cl.
CPC .... *A62B 3/00* (2013.01); *A62B 1/06* (2013.01)

(58) Field of Classification Search
CPC ..... A62B 3/00
USPC ..... 182/5, 6, 7, 70
See application file for complete search history.

(56) References Cited

U.S. PATENT DOCUMENTS

| | | | | |
|---|---|---|---|---|
| 2,335,898 | A * | 12/1943 | Arnold | 150/112 |
| 4,662,517 | A * | 5/1987 | Wirth | 206/388 |
| 4,688,674 | A * | 8/1987 | Stirtz | 206/388 |
| 4,949,401 | A * | 8/1990 | Kimsey, Jr. | 2/102 |
| 5,099,530 | A * | 3/1992 | Scott | 5/420 |
| 5,439,154 | A * | 8/1995 | Delligatti | 224/601 |
| 5,746,311 | A * | 5/1998 | Brown et al. | 206/63.3 |
| 5,785,219 | A * | 7/1998 | Kraft | 224/576 |
| 5,868,219 | A * | 2/1999 | Sadeck et al. | 182/70 |
| 5,970,517 | A * | 10/1999 | Jordan | 2/69 |
| 6,298,993 | B1 * | 10/2001 | Kalozdi | 206/581 |
| 6,516,920 | B1 * | 2/2003 | Schafler | 182/70 |
| 6,547,113 | B1 * | 4/2003 | Hancock et al. | 224/408 |
| 6,800,007 | B2 * | 10/2004 | Calkin | 441/84 |
| 6,880,702 | B1 * | 4/2005 | Colorado | 206/388 |
| 6,902,087 | B2 * | 6/2005 | Hancock et al. | 224/401 |
| D599,502 | S * | 9/2009 | Mack et al. | D29/124 |
| 8,091,321 | B2 * | 1/2012 | Malinowski et al. | 53/430 |
| 8,123,027 | B2 * | 2/2012 | Kirkham | 206/3 |
| 8,261,877 | B2 * | 9/2012 | Botti | 182/5 |
| D668,456 | S * | 10/2012 | Du | D3/285 |
| 8,403,011 | B1 * | 3/2013 | McKendry | 150/104 |
| 8,490,230 | B2 * | 7/2013 | Rovin | 5/655 |
| 2002/0074185 | A1 * | 6/2002 | Colorado | 182/6 |
| 2002/0074251 | A1 * | 6/2002 | Hirshberg | 206/315.1 |
| 2008/0230313 | A1 * | 9/2008 | Botti | 182/70 |
| 2011/0314608 | A1 * | 12/2011 | Rovin | 5/655 |
| 2012/0311788 | A1 * | 12/2012 | Jackson, II | 5/655 |
| 2013/0341123 | A1 * | 12/2013 | McMahon | 182/6 |

* cited by examiner

*Primary Examiner* — Katherine Mitchell
*Assistant Examiner* — Candace L Bradford
(74) *Attorney, Agent, or Firm* — Wood Phillips Katz Clark & Mortimer

(57) ABSTRACT

An emergency rope bail-out bag (10) is provided for use and wear by a firefighter or other first responder or emergency rescuer, the bag (10) including a main body (12) for stowing a rope (28), an escape hook (26), and a rappelling device (37); and a tear-away flap (14) that can be grasped with a single hand of a user and pulled away from the main body (12) so as to expose the escape hook (26), the rappelling device (37), and the rope (28) for rapid deployment in an emergency.

15 Claims, 7 Drawing Sheets

EMERGENCY ROPE BAIL-OUT BAG

CROSS-REFERENCE TO RELATED APPLICATIONS

This application claims the benefit of the filing date of U.S. Provisional Application No. 61/346,879, filed May 20, 2010, which is hereby incorporated by reference.

FEDERALLY SPONSORED RESEARCH OR DEVELOPMENT

Not Applicable.

MICROFICHE/COPYRIGHT REFERENCE

Not Applicable.

FIELD

This disclosure relates to emergency escape/bail-out equipment used by firefighters, first responders, and other emergency workers and rescuers.

BACKGROUND

There is a continuing need for firefighters, first responders, and other emergency workers and rescuers to be provided with safety equipment that allows for emergency egress from structural fires that are above grade. Typically, such devices will include an emergency escape hook (many of which are known), a length of NFPA compliant rope, and a rappelling device that will allow the firefighter to safely descend the rope after securing an end of the rope to the structure via the escape hook. This equipment must somehow be carried on the body of a firefighter while still being accessible for emergency deployment and use.

SUMMARY

An emergency rope bail-out bag is provided for use and wear by a firefighter or other first responder or emergency rescuer. The emergency rope bail-out bag is configured for attachment to the rescue belt or class II harness worn by a firefighter and in some embodiments provides for an adaptive fit so as to accommodate the various waist sizes and shapes of the firefighters, emergency rescuers and first responders who may wish to utilize the emergency rope bail-out bag. The bag can allow for at least a forty foot length of NFPA compliant rope, an escape hook, and a rappelling device and carabineer, to be safely stowed and carried in an unobtrusive manner while being readily available for quick and immediate deployment by a wearer should an emergency need arise. In some embodiments, the bag includes a main body for stowing the rope, the escape hook, and the rappelling device, and a tear-away flap that can be grasped with a single hand of a user and pulled away from the main body so as to expose the escape hook, the rappelling device, and the rope for rapid deployment in an emergency.

Other features and advantages will become apparent from a review of the entire specification, including the appended claims and drawings.

DETAILED DESCRIPTION

Figure 1:
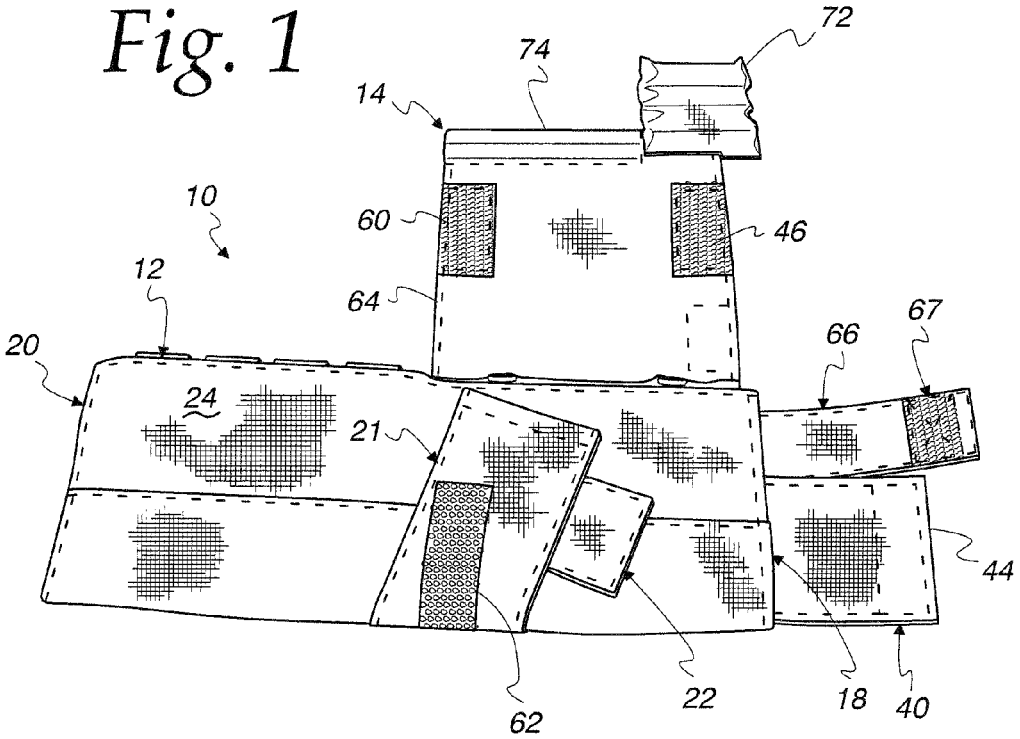
FIG. 1 is a plan view of an emergency rope bail-out bag embodying the present invention, showing a surface of the bag that faces away from a wearer when donned and illustrating selected flaps of the bag in a deployed position.
Figure 2:
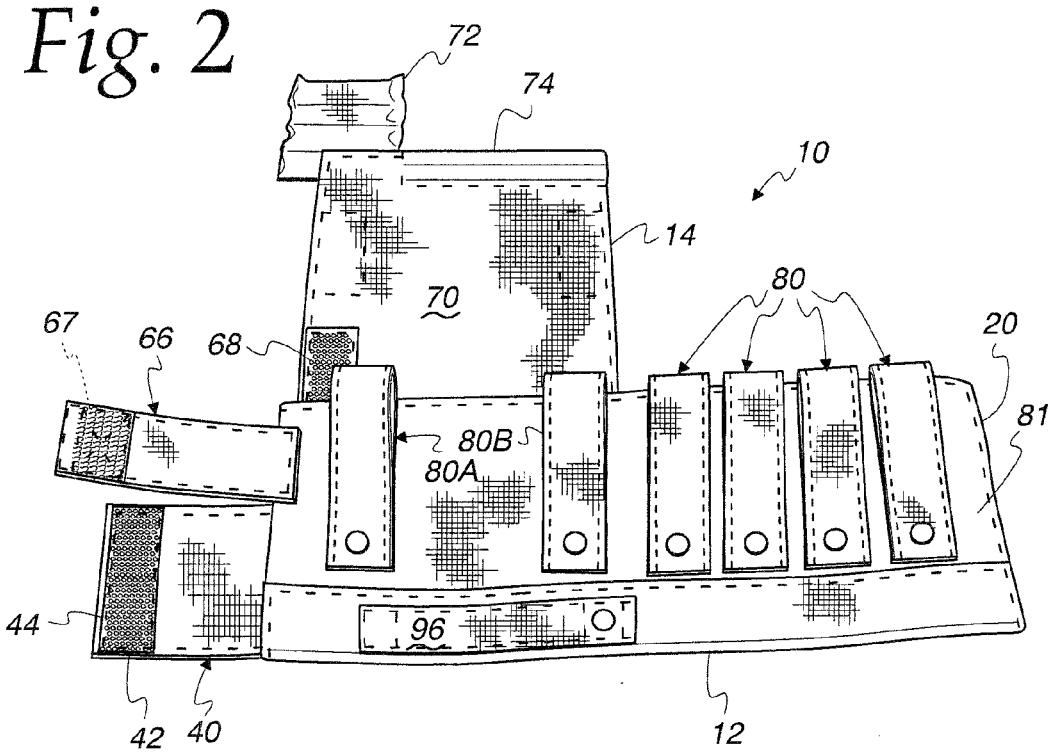
FIG. 2 is a plan view of the bail-out bag of FIG. 1 but showing an opposite side of the bag that faces a wearer when donned.
Figure 3:
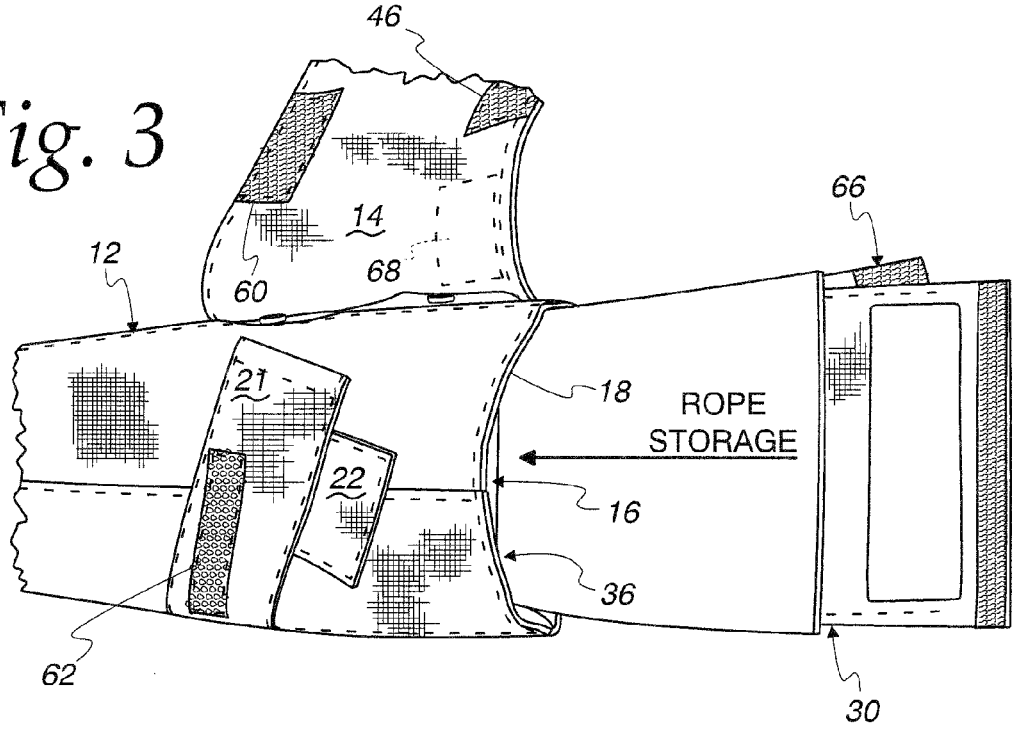
FIG. 3 is a view taken from one lateral end of the bag of FIGS. 1 and 2 showing only a portion of the bag and illustrating an opening to an interior compartment of the bag, with a placard inserted into the opening to illustrate the rope storage.
Figure 4:
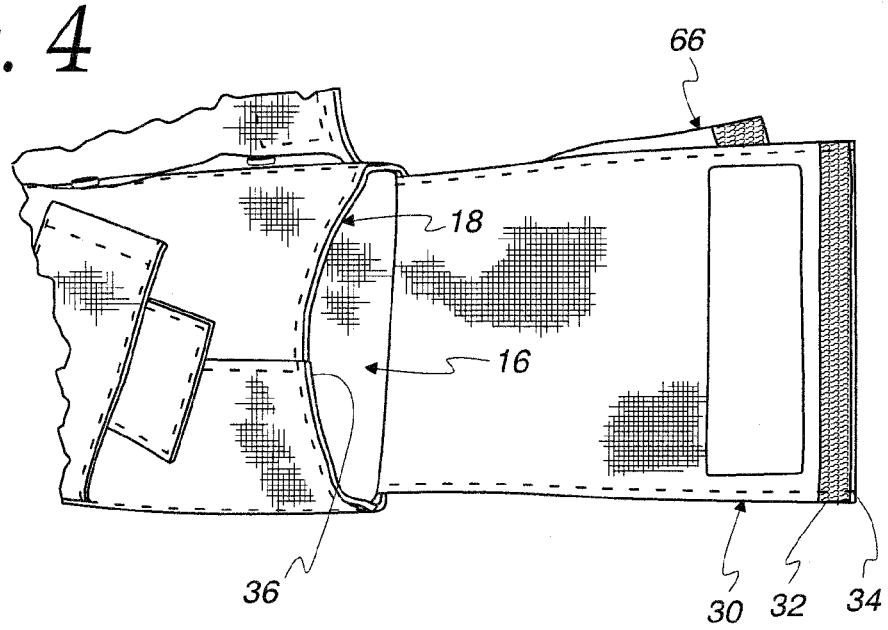
FIG. 4 is a view similar to FIG. 3, but with the placard removed.

With reference FIGS. 1 and 2 an emergency rope bail-out bag 10 is shown and is adapted for use and wear by a firefighter or other first responder or emergency rescuer. The emergency rope bail-out bag 10 is configured for attachment to the rescue belt or class II harness worn by a firefighter and provides for an adaptive fit so as to accommodate the various waist sizes and shapes of the firefighters, emergency rescuers and first responders who may wish to utilize the emergency rope bail-out bag 10. The bag 10 allows for at least a forty foot length of NFPA compliant rope, an escape hook, and a rappelling device (such as a Grigri rappelling/belay device) and carabineer, to be safely stowed and carried in an unobtrusive manner while being readily available for quick and immediate deployment by a wearer should an emergency need arise (the rope, hook, rappelling device and carabineer are not shown in FIGS. 1 and 2). In this regard, the bag 10 includes a main body 12 for stowing the rope, escape hook, and rappelling device, and a primary flap in the form of a tear-away or break-away flap 14 that can be grasped with a single hand of a user and pulled away from the main body 12 so as to expose the escape hook, rappelling device, and rope for rapid deployment in an emergency.

Figure 1A:
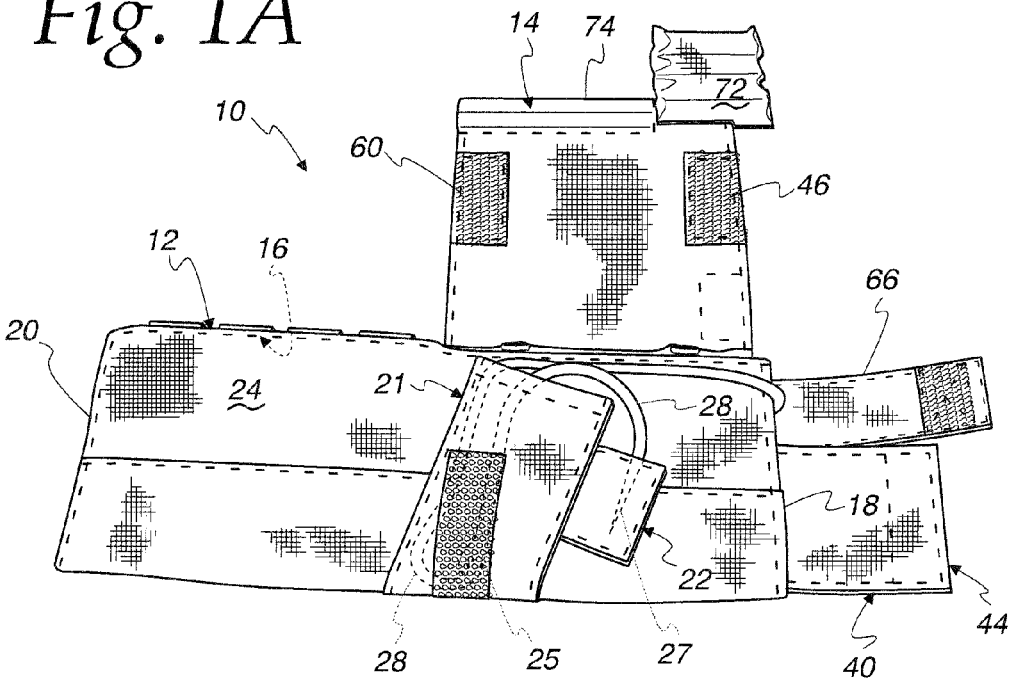
FIG. 1A is a view similar to FIG. 1, but showing an emergency rope and escape hook in a stowed or un-deployed position in the bag.

As best seen in FIGS. 1-4, the main body 12 is tube shaped to define an interior cavity 16 extending from a mouth opening 18 to a closed end 20 that is spaced laterally opposite from the opening 18. The cavity 16 is used to store both the rope and the rappelling device in the un-deployed state, with both the rope and the rappelling device being inserted into the cavity 16 via the mouth opening 18. As best seen in FIGS. 1 and 1A, a hook storage location/compartment is provided in the form of a pair of hook retaining pockets 21 and 22 provided at an exterior surface 24 of the main body 12 that faces away from a wearer. The larger pocket 21 is configured to receive and retain the shank 25 of the escape hook 26 and the smaller pocket 22 is configured to receive and retain the pointed end 27 of the escape hook 26, with both pockets 21 and 22 being sized to accept popular embodiments of escape hooks that are currently available. One end of the rope 28 extends from the eyelet on the shank of the escape hook stowed within the pocket 21, past the mouth opening 18 and to the remainder of the rope 28 stowed within the cavity 16.

Figure 5:
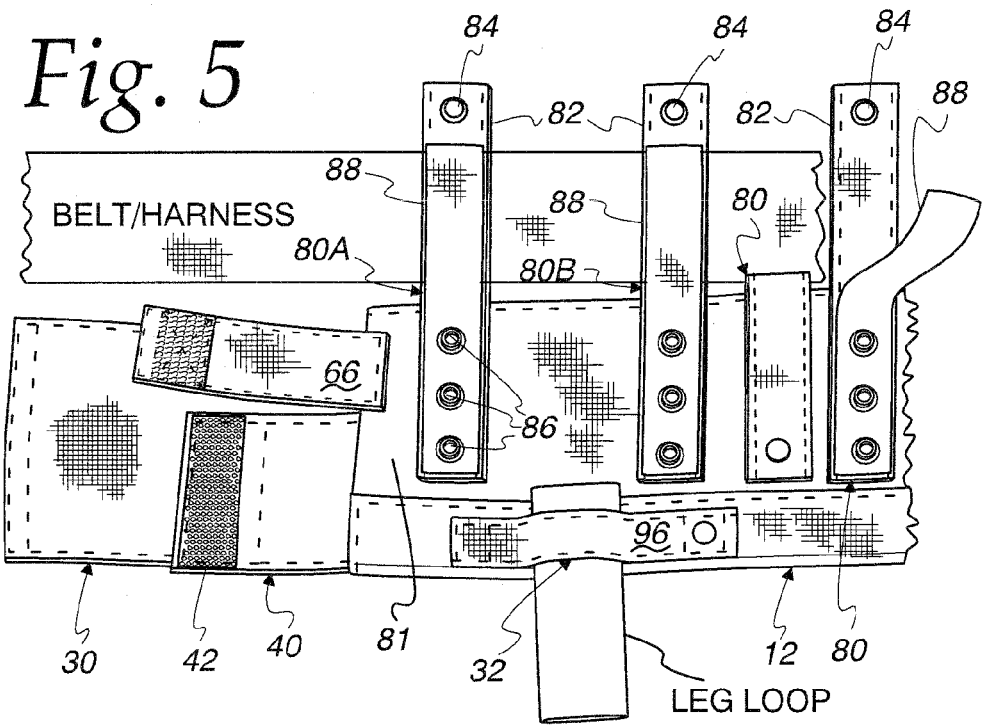
FIG. 5 is a view similar to FIG. 2, but showing only a portion of the bag and including placards to illustrate the attachment of the bag to a belt or harness of a wearer when donned.
Figure 6:
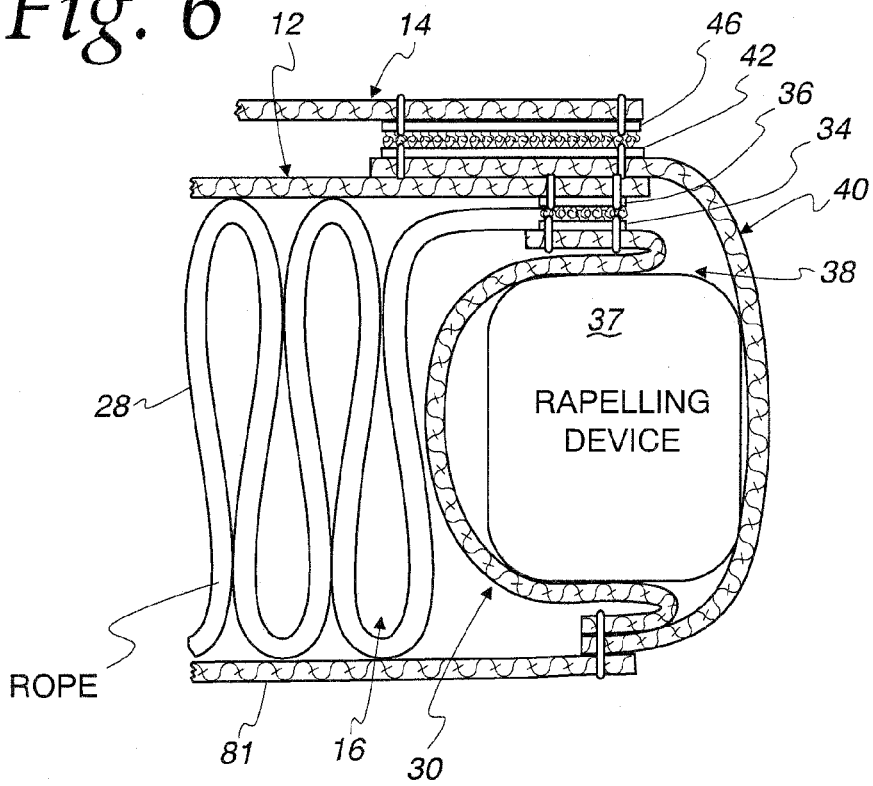
FIG. 6 is a sectional illustration with a somewhat diagrammatic representation of several of the flaps of the bag and an emergency rope and rappelling device in an un-deployed or stowed position.
Figure 7:
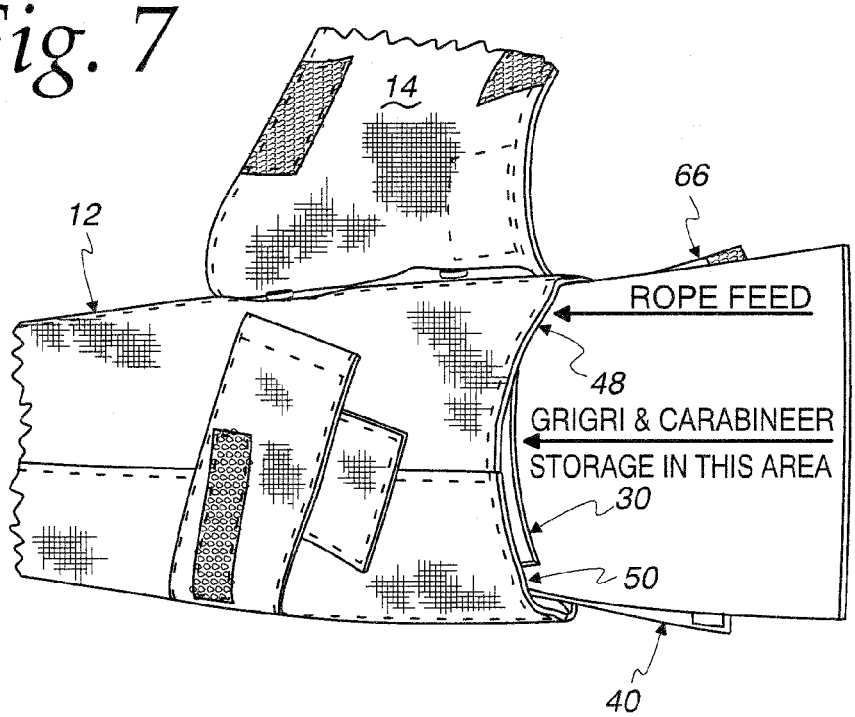
FIG. 7 is a view of the open end of the bag showing one of the flaps in an un-deployed or stowed position, with a placard positioned to indicate certain features of the bag.

As best seen in FIGS. 3-6, a first or divider flap 30 is attached to and extends from a portion of the mouth opening 18 that is closest to the body of a wearer when donned. The first flap 30 has a hook and loop fastener 32 extending over the vertical length of its free edge 34 for engagement with a mating hook and loop fastener 36 extending over a circumferential portion on the interior of the mouth opening 18 opposite from where the flap 30 is attached to the body 12. When the hook and loop fasteners 32 and 36 are engaged, the flap 30 can be pushed into the interior cavity 16 and formed into a "U" shaped portion so as to bound a storage location/compartment or space 38 for the rappelling device 37 that is separated from a storage location/compartment or space 39 for the emergency rope to discourage entanglement of the rope with the rappelling device, as best seen in FIG. 6 (it should be noted that the flap 30 is in the stowed position in FIGS. 1, 1A, 2 and 6-9).

Figure 8:
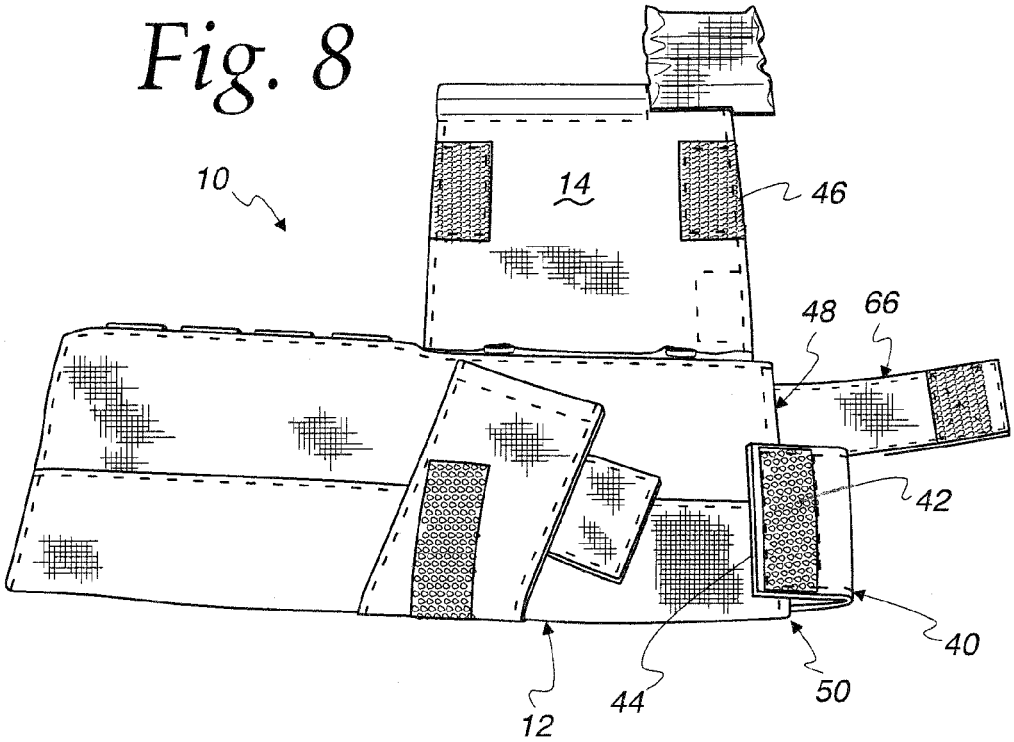
FIG. 8 is a view similar to FIG. 1 but showing another flap of the bag in an un-deployed or stowed position.
Figure 9:
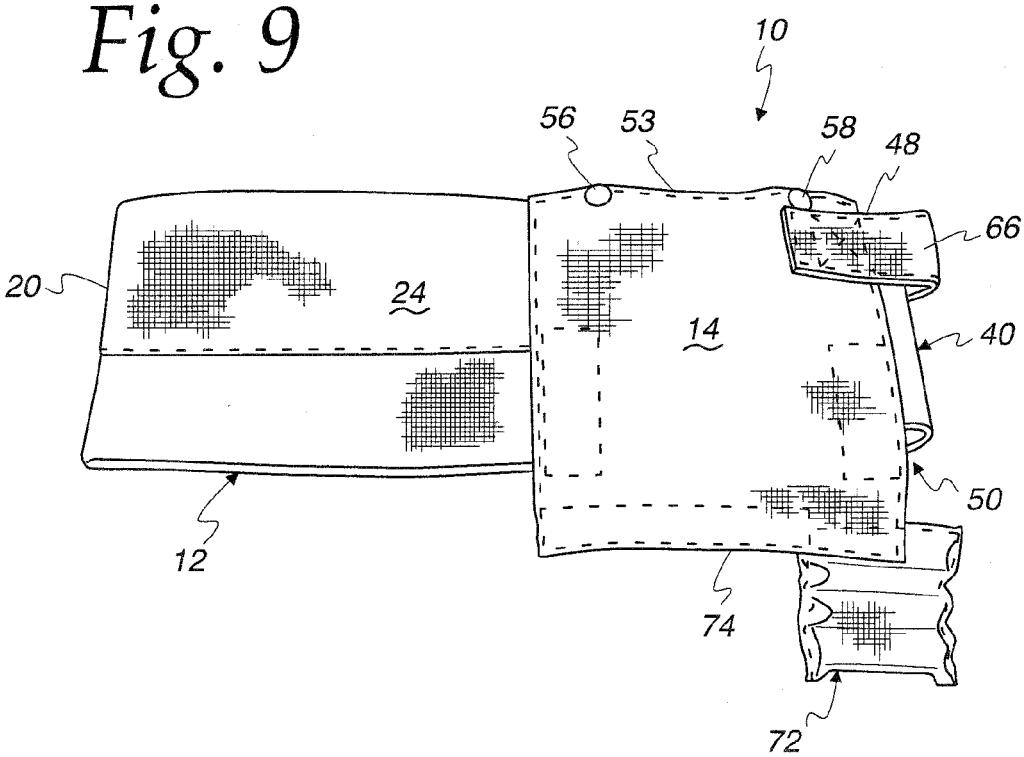
FIG. 9 is a view of the bag with all of its components shown in the un-deployed or stowed condition.

As shown in FIGS. 1, 2, 5, 6, 7 and 8, a second or containment flap 40 is attached to and extends from the mouth opening 18 adjacent the first flap 30, with the second flap 40 being located behind the first flap 30 (best seen in FIG. 5). With the emergency rope 28 and the rappelling device 37 stored in their respective locations/compartments in the interior cavity 16, the second flap 40 can be folded over the mouth opening 18 so as to retain the rappelling device 37 within the compartment/space 38, as best seen in FIGS. 6, 8 and 9. In this regard, as best seen in FIGS. 5, 6 and 8, the flap 40 has a hook and loop connector 42 extending over the vertical length of its free edge 44 that is engageable with a mating hook and loop connector 46 on the tear away flap 14 to retain the flap 40 in the un-deployed state. With both of the flaps 30 and 40 in the un-deployed position shown in FIG. 8, one end of the emergency rope 28 can extend through a opening/gap 48 to the eyelet on the shank of the escape hook 26 stowed in the pocket 20, and the other end of the rope can extend through an opening/gap 50 for attachment to the rescue belt or class II harness on the wearer.

Figure 10:
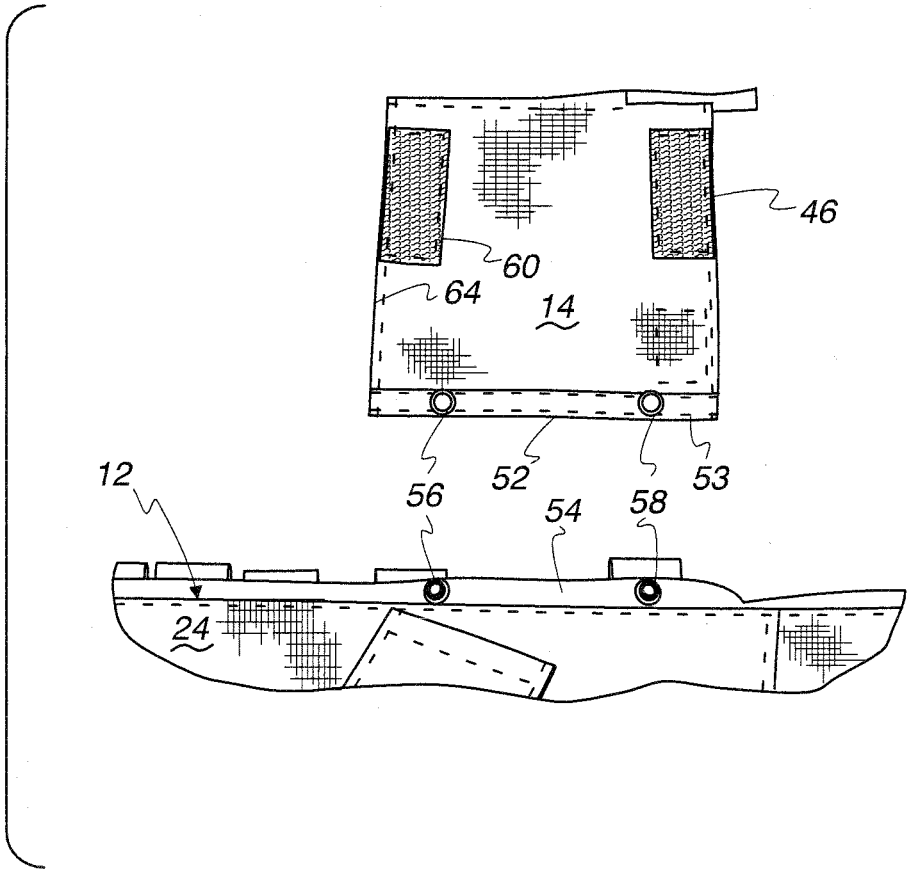
FIG. 10 is a view of an upper portion of the bag and a tear-away flap of the bag, with the tear-away flap shown in a deployed position.
Figure 11:
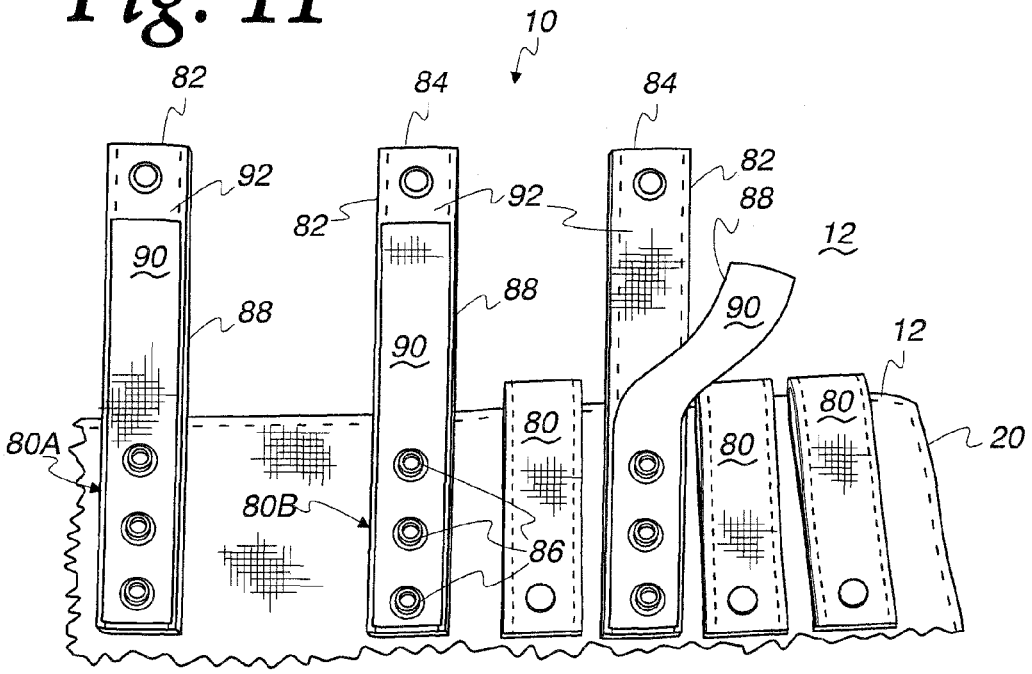
FIG. 11 is an enlarged view of a selected portion of the body side of the bag.

As best seen in FIG. 10, the tear-away flap 14 includes a hook and loop fastener 52 that extends laterally over the length of an attachable edge 53 and is engageable with a mating hook and loop fastener 54 on the surface 24 of the main body 12 to removably attach the flap 14 to the main body 12. Preferably, two mating pairs of snap fasteners 56 and 58 are provided on the flap 14 and the body 12 within the area of the hook and loop fasteners 52 and 54 to provide accurate location of the flap 14 relative to the main body 12 when attached. As best seen in FIG. 1, another set of mating hook and loop fasteners 60 and 62 are provided on the tear-away flap 14 and the main body 12 so that the lateral side edge 64 of the flap 14 can be secured to the body 12 in the un-deployed position. As best seen in FIGS. 1 and 2, a tab 66 is attached to the main body 12 adjacent the flaps 30 and 40 and includes a hook and loop fastener 67 that is engageable with a hook and loop fastener 68 on an exterior facing side 70 of the flap 14 in the un-deployed state, as shown in FIGS. 9 and 11, with the tab 66 serving to protect/hide any portion of the rope that is exposed as it extends from the opening 48 to the eyelet of the escape hook. As seen in FIGS. 1, 2, and 9, a grip 72 is preferable provided on the free edge 74 of the flap 14 to make it easier for a firefighter to grasp the flap 14 with a gloved hand to tear the flap 14 from the main body 14.

Figure 12:
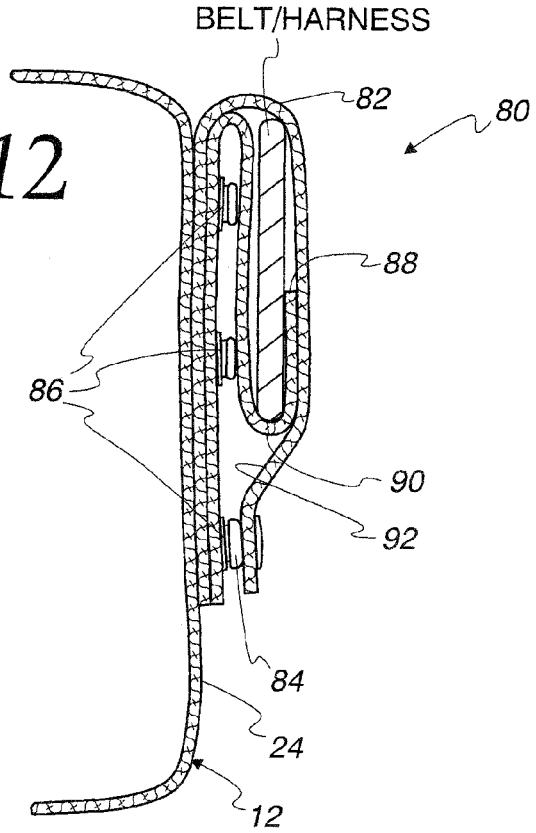
FIG. 12 is a somewhat diagrammatic, sectional illustration of a belt attachment of the bag.

As best seen in FIGS. 2, 5, and 12, a plurality of belt loop attachments 80 are provided on a surface 81 of the main body 12 that faces a wearer. As best seen in FIG. 5, each of the attachments 80 includes a movable tab 82 having a snap fastener 84 thereon that is engageable with any one of a plurality of mating snap fasteners 86 vertically spaced on the main body 12 to accommodate various transverse widths of rescue belts and/or class II harnesses. As best seen in FIGS. 12 and 13, each of the attachments 80 also includes another movable tab 88 having a hook and loop type fastener 90 extending over its length for engagement with a hook and loop fastener 92 on the tab 82 after having been wrapped around the rescue belt or class II harness of a wearer so as to better secure the bag 10 to the belt or class II harness. As best seen in FIG. 2, in the illustrated embodiment, the attachments 80A and 80B are preferably located on the main body 12 to accurately position the bag 10 relative to the body of the wearer when donned. In this regard, the laterally spacing between the attachments 80A and 80B is selected to accommodate a belt loop on a pant/trouser of the wearer that is typically adjacent the right hand pocket of the pant/trouser. This positions the mouth opening 18 and the flap 14 adjacent the right hand pocket for convenient access by the wearer, with the remainder of the bag 10 extending around the waist of a wearer to adjacent the small of the wearer's back. In this regard, one or more of the remaining attachments 80 may be engaged around the rescue belt or harness of the wearer, with the lateral spacing of the remaining attachments 80 allowing for a custom fit of the bag 10 to the wearer. Additionally, as best seen in FIG. 5, another attachment 96 extends horizontally below the attachments 80A and 80B for engagement with a leg loop of the harness of the wearer. The construction of the attachment 96 is the same as the construction of the other attachments 30.

The bag can be made from any suitable materials, especially those that will be NFPA compliant. For example, the exterior of the bag 10 can be made from a Nomex material, and the interior of the compartment 16 can be lined with a Kevlar material. Further, additional layers of material can be added to selected portions of the body 12 for abrasion resistance and/or structural reinforcement. In many embodiments, the various fabric components of the bag 10 are attached to each other via suitable stitching.

It should be appreciated that, with the bag 10 initially in an un-deployed condition, a wearer can use a single hand to grasp the flap 14 and tear it away from the main body 12 in a single motion that separates the fasteners 44, 46, 52, 54, 56, 58, 60, and 62, thereby exposing the escape hook and rappelling device for quick deployment in an emergency.

It should also be appreciated by those skilled in the art that there are a number of alternate constructions and/or components that could be utilized to replace the specific forms shown in the described and illustrated embodiments of the bag 10, and accordingly no limitation to a specific construction or component is intended unless specifically recited in the claims.

The invention claimed is:

1. An emergency rope bail-out bag for use by a firefighter or other first responder or emergency rescuer, the bail-out bag comprising:

a length of rope;

a rappelling device;

an escape hook;

a main body having separate storage compartments for each of the length of rope, the rappelling device, and the escape hook; and a primary flap that is configured to move: (a) from a stow position wherein the storage compartments are covered so as to retain the length of rope, the rappelling device, and the escape hook in a stowed condition in their respective storage compartments; and (b) to a deploy position as an incident of which the storage compartments are caused to be exposed so as to allow deployment of the escape hook, rappelling device, and rope by a user, wherein the main body defines a cavity having an open end, and further comprising a divider flap located to divide the cavity into a first storage compartment of the separate storage compartments in which the length of rope is stored and a second storage compartment of the separate storage compartments in which the rappelling device is stored, wherein the main body has an exterior surface at which a third storage compartment of the separate storage compartments for the escape hook is defined, wherein the primary flap in the stow position overlays the third storage compartment for the escape hook.

2. The bail-out bag of claim 1 further comprising a containment flap movable between a stowed position wherein the containment flap extends across the open end of the cavity to cover the second storage location and a deployed position wherein the second storage location is opened to expose the rappelling device stored therein.

3. The bail-out bag of claim 2 wherein the containment flap and the primary flap are fastened together and configured so that the containment flap moves to the deployed position in response to the movement for the primary flap from the stow position to the deploy position.

4. The bail-out bag of claim 1 further comprising a pair of belt loop attachments located on the exterior surface of the main body on a side of the main body opposite from where the third storage compartment is located, the pair of belt loop attachments spaced from each other to allow the belt loop attachments to be located on opposite sides of a feature on a garment worn by a user for positive location of the bail-out bag relative to the body of a user.

5. The bail-out bag of claim 4 further comprising a series of additional belt loop attachments spaced along the main body to allow an adaptive fit of the bail-out bag to a variety of user's and garments, belts, or harnesses worn by a user.

6. The bail-out bag of claim 1 wherein the primary flap is configured to be removably attached to the main body to allow the primary flap to be completely separated from the main body in the deploy position.

7. An emergency rope bail-out bag for use by a firefighter or other first responder or emergency rescuer, the bail-cut bag comprising:

a main body defining an interior cavity having an open end;

a divider flap located in the cavity and formed into a AU" shaped portion so as to divide the cavity into a first storage compartment to store a length of rope and a second storage compartment to store a rappelling device;

a containment flap movable between a stowed position wherein the containment flap extends across the open end of the cavity to cover the second storage location and a deployed position wherein the second storage location is opened to allow a rappelling device stored therein to be accessed; and a primary flap that is movable from a stow position to a deploy position, the primary flap and the containment flap fastened to each other so that the containment flap moves to the deployed position in response to the movement for the primary flap from the stow position to the deploy position, wherein the main body has an exterior surface where a third storage compartment stores an escape hook, and wherein the primary flap in the stow position overlays the third storage compartment.

8. The bail-out bag of claim 7 further comprising a pair of belt loop attachments located on the exterior surface of the main body on a side of the main body opposite from where the third storage compartment is located, the pair of belt loop attachments spaced from each other to allow the belt loop attachments to be located on opposite sides of a feature on a garment worn by a user for positive location of the bail-out bag relative to the body of a user.

9. The bail-out bag of claim 8 further comprising a series of additional belt loop attachments spaced along the main body to allow an adaptive fit of the bail-out bag to a variety of user's and garments, belts, or harnesses worn by a user.

10. The bail-out bag of claim 7 wherein the primary flap is removably attached to the main body to allow the primary flap to be complete separated from the main body in the deploy position.

11. A method for stowing and deploying a rope, rappelling device, and escape hook, the method comprising the steps of:

locating a rope, a rappelling device, and an escape hook in specific preselected compartments on a user with the rope, rappelling device and escape hook covered at their respective compartments; and grasping a single flap and moving the single flap from a stow position to a deploy position as an incident of which a plurality of additional flaps releasably connected to the single flap are released from the single flap to expose the rope the rappelling device and the escape hook for deployment.

12. The method of claim 11 wherein the locating step comprises stowing the rope and rappelling device in a cavity of a bag with a divider located between the rope and rappelling device that divides the cavity into separate compartments.

13. The method of claim 12 wherein the stowing step further comprises stowing the escape hook in a respective compartment that is in the form of a pocket at an exterior of the bag.

14. The method of claim 11 wherein the locating step comprises locating at least one of the rappelling device and the escape hook adjacent a specific pocket of a garment worn by a user.

15. The method of claim 11 wherein the locating step comprises locating the rope, the rappelling device, and the escape hook in a bag and attaching the bag to a specific location on a belt or harness worn by a user.

* * * * *